US010865666B2

(12) United States Patent
Bruce et al.

(10) Patent No.: US 10,865,666 B2
(45) Date of Patent: Dec. 15, 2020

(54) CHECK VALVE FOR EXHAUSTING FLOW OF FLUID FROM A VARIABLE CAM TIMING PHASER

(71) Applicant: BorgWarner Inc., Auburn Hills, MI (US)

(72) Inventors: Adam Bruce, Ithaca, NY (US); Keith Feldt, Ithaca, NY (US); Braman Wing, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 16/671,483

(22) Filed: Nov. 1, 2019

(65) Prior Publication Data

US 2020/0141288 A1 May 7, 2020

Related U.S. Application Data

(60) Provisional application No. 62/755,688, filed on Nov. 5, 2018.

(51) Int. Cl.
*F01L 1/344* (2006.01)

(52) U.S. Cl.
CPC ... *F01L 1/3442* (2013.01); *F01L 2001/34426* (2013.01); *F01L 2001/34436* (2013.01)

(58) Field of Classification Search
CPC ..... F01L 1/34409; F01L 1/3442; F01L 2001/34423; F01L 2001/34426; F01L 2001/3443; F01L 2001/34433; F01L 2001/34436; F01L 2001/34479; F01L 1/46
USPC ..... 123/90.15, 90.17
See application file for complete search history.

(56) References Cited

U.S. PATENT DOCUMENTS

| | | | |
|---|---|---|---|
| 6,453,859 | B1 | 9/2002 | Smith et al. |
| 6,763,791 | B2 | 7/2004 | Gardner et al. |
| 7,434,554 | B2 | 10/2008 | Nagashima |
| 7,946,266 | B2 | 5/2011 | Knecht et al. |
| 8,789,504 | B2 | 7/2014 | Scheidig |
| 8,881,699 | B2 | 11/2014 | Church |
| 8,931,451 | B2 | 1/2015 | Scheidig |
| 9,803,520 | B2 | 10/2017 | Smith et al. |
| 10,344,632 | B2 | 7/2019 | Smith |

(Continued)

FOREIGN PATENT DOCUMENTS

| | | | |
|---|---|---|---|
| DE | 102016104561 | A1 | 9/2017 |
| JP | 2000034913 | A | 2/2000 |

(Continued)

*Primary Examiner* — Jorge L Leon, Jr.
(74) *Attorney, Agent, or Firm* — Brown & Michaels, PC

(57) ABSTRACT

A variable cam timing phaser mounted to a camshaft and including a housing assembly having an outer circumference for accepting a drive force; a rotor assembly received by the housing assembly defining a chamber separated into an advance chamber and retard chamber by a vane; a control valve in fluid communication with the advance chamber and the retard chamber, a source of fluid, and a sump through at least one exhaust line connected to at least one exhaust port; and at least one check valve in the at least one exhaust line between the control valve and the sump. The at least one check valve prevents air from the sump connected to the at least one exhaust port from being sucked into the variable cam timing phaser through the at least one exhaust port during a torque reversal of the camshaft.

15 Claims, 8 Drawing Sheets

(56) References Cited

U.S. PATENT DOCUMENTS

| | | | | |
|---|---|---|---|---|
| 2002/0088413 | A1* | 7/2002 | Smith | F01L 1/3442 123/90.15 |
| 2002/0139332 | A1 | 10/2002 | Takenaka | |
| 2003/0230268 | A1* | 12/2003 | Simpson | F01L 1/34409 123/90.17 |
| 2011/0017156 | A1 | 1/2011 | Smith | |
| 2012/0097122 | A1 | 4/2012 | Lichti | |
| 2015/0019106 | A1 | 1/2015 | Cunningham et al. | |
| 2015/0300213 | A1 | 10/2015 | Kaufmann et al. | |
| 2016/0130988 | A1 | 5/2016 | Smith et al. | |
| 2017/0058727 | A1 | 3/2017 | Smith et al. | |
| 2017/0130618 | A1 | 5/2017 | Haltiner, Jr. | |

FOREIGN PATENT DOCUMENTS

| | | | |
|---|---|---|---|
| JP | 2009068500 | A | 4/2009 |
| JP | 2009264133 | A | 11/2009 |
| JP | 2011513651 | A | 4/2011 |
| WO | 2017157900 | A1 | 9/2017 |

* cited by examiner

CHECK VALVE FOR EXHAUSTING FLOW OF FLUID FROM A VARIABLE CAM TIMING PHASER

CROSS-REFERENCE TO RELATED APPLICATIONS

This application claims the benefit of U.S. Patent Application No. 62/755,688 filed on Nov. 5, 2018, the disclosure of which is herein incorporated by reference in its entirety.

BACKGROUND OF THE INVENTION

Field of the Invention

The invention pertains to the field of variable cam timing. More particularly, the invention pertains to check valves for use in variable cam timing phasers.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor assembly 246 with one or more vanes 216, mounted to the end of the camshaft, surrounded by a housing assembly 201 with the vane chambers into which the vanes 216 fit. It is possible to have the vanes 216 mounted to the housing assembly 201, and the chambers in the rotor assembly 246, as well. The housing's outer circumference 200 forms the sprocket, pulley or gear accepting drive force through a chain, belt, or gears, usually from the crankshaft, or possible from another camshaft in a multiple-cam engine.

Referring to FIGS. 1*a* and 1*b*, the phaser operating fluid 222, illustratively in the form of engine lubricating oil, flows into the chambers 217*a* labeled "A" for "advance" and 217*b* labeled "R" for "retard" by way of a common inlet line 210. An inlet check valve 218 prevents the hydraulic fluid from backflow into the engine oil supply S. Inlet line 210 terminates as it enters the spool valve 209. The control valve 209 is made up of a spool 204 and a cylindrical member 215. The spool 204, which is preferably a vented spool, is slidable back and forth. The spool 204 fits snugly within cylindrical member 215. The spool 204 preferably has at least three positions, but only two of these positions, biasing the phaser toward advance and retard, will be described in more detail below.

Control of the position of spool 204 within cylindrical member 215 is in direct response to an electromechanical actuator 203. An electrical current is introduced via a cable through the solenoid housing into a solenoid coil which repels, or "pushes" an armature 227 of the electromechanical actuator 203. The armature 217 bears against the spool 204, which is biased by a spring 229. If the force of spring 229 is in balance with the force exerted by armature 217 in the opposite direction, the spool 204 will remain in position. If the force of the spring 229 is greater than that exerted by the actuator 203, the spool 204 moves in one direction, and if the force of the actuator 203 is greater than that exerted by the spring 229, the spool 204 moves in the opposite direction. Thus, the spool 204 is moved in either direction by increasing or decreasing the current to the solenoid coil, as the case may be.

Referring to FIG. 1*a*, to advance the phaser, source hydraulic fluid 222 is ported to the advance chamber 217*a* by shifting the spool valve 204 to the left. The pressure of the hydraulic fluid in the advance chamber 217*a* moves the vane 216 towards the retard chamber 217*b*. At the same time, the retard chamber 217*b* is exhausted to atmosphere through exhaust port 207.

Referring to FIG. 1*b*, to retard the phaser, the spool valve 204 is moved to the right, and source hydraulic fluid 222 is ported to the retard chamber 217*b* and the hydraulic fluid 222 in the advance chamber 217*a* is exhausted to the atmosphere through exhaust port 206.

In internal combustion engines, the camshaft on which the phaser is mounted is acted upon by forces imparted by the intake and/or exhaust valves which are operated by the cams on the camshaft. These forces, called "torsionals" or "torque reversals", cause the camshaft to twist, slightly oscillating angularly back and forth, rather than rotating smoothly. As a result, while the variable cam timing system is attempting to move the phaser toward the advance or retard positions, the phaser is subject to torsional forces which can make the vanes 216 of the phaser move back and forth within the chambers 217*a*, 217*b*, overcoming the oil pressure which is attempting to move the vane 216 in one direction or the other.

It will be noted that in either of the advancing setting of FIG. 1*a* or the retarding setting of FIG. 1*b*, the vent or exhaust ports 206 and 207 are freely communicating with the atmosphere, usually the oil sump of the engine, which is at atmospheric pressure.

Therefore, if the phaser is being moved toward the advance position as in FIG. 1*a*, for example, and if the rotor assembly 246 of the phaser experiences a torque reversal toward the retard direction, there will be a suction created by the movement of the vane 216 toward retard position (advance wall 201*a*), and thus air from the oil sump can be sucked back into the retard chamber 217*b* through the open exhaust port 207.

Similarly, if the phaser is being moved toward the retard position as in FIG. 1*b*, for example, and if the rotor 246 of the phaser experiences a torque reversal toward the advance direction, there will be a suction created by the movement of the vane 216 toward advance position (retard wall 201*b*), and thus air from the oil sump can be sucked back into the advance chamber 217*a* through the open exhaust port 206.

If this should occur, the advance or retard chamber may ingest air, which can lead to phaser oscillation.

SUMMARY OF THE INVENTION

In one embodiment, a check valve is placed on at least one of the exhaust ports of a torsion assist phaser to reduce the air ingested into the phaser during a cam torque reversal.

In one embodiment, a check valve is placed on the exhausting recirculating cam torque actuated (CTA) flow, and can prevent air ingestion into the phaser when a camshaft torque reversal occurs. This check valve improves phaser stability by reducing air ingested into the phaser. The check valve can also be used to tune the transition from CTA to torsion assist (TA) thru preload of the check valve.

In another embodiment, a check valve is placed on at least one exhaust port of a phaser which partially exhausts recirculating fluid between chambers of the phaser to reduce the air ingested into the phaser.

In one embodiment, a sleeve for a control valve of a variable cam timing device is disclosed. The bore receives a spool and an outer surface of the spool receives at least a first check valve for a first exhaust port and a second check valve for a second exhaust port. The first and second check valves prevent air from a sump connected to the first exhaust port and the second exhaust port from being sucked into the variable cam timing device through the first exhaust port and the second exhaust port during a torque reversal of a camshaft the variable cam timing device is mounted to.

In another embodiment, the sleeve is not present and the first and second check valves are present in the rotor assembly, in the housing of a center bolt or in the cam.

In one embodiment, the first check valves and second check valve are a band check valve, a disc check valve, ball check valve or a combination thereof.

In another embodiment, a flapper spring is used on the control valve and exhaust ports of a phaser.

DETAILED DESCRIPTION OF THE INVENTION

The invention presents an improved control valve for variable cam timing (VCT) phasers which incorporates check valves in the exhaust ports to minimize air ingestion during cam reversals.

Figure 1A:
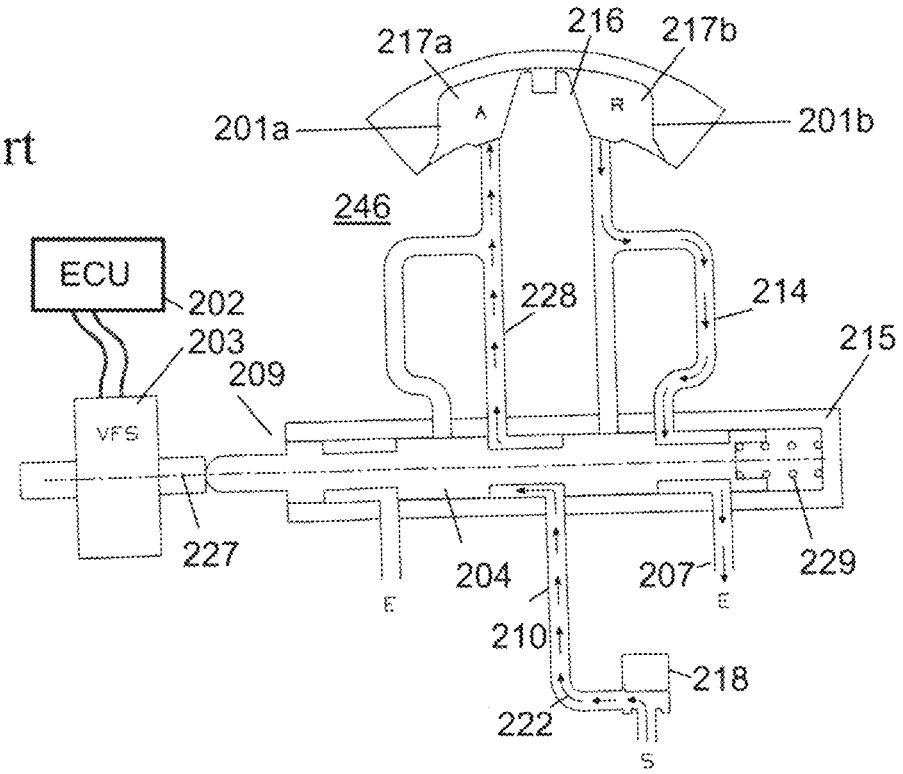
Fig. 1a Prior Art
FIG. 1*a* shows a schematic view of a prior art cam phaser with the control valve set for advance.
Figure 1B:
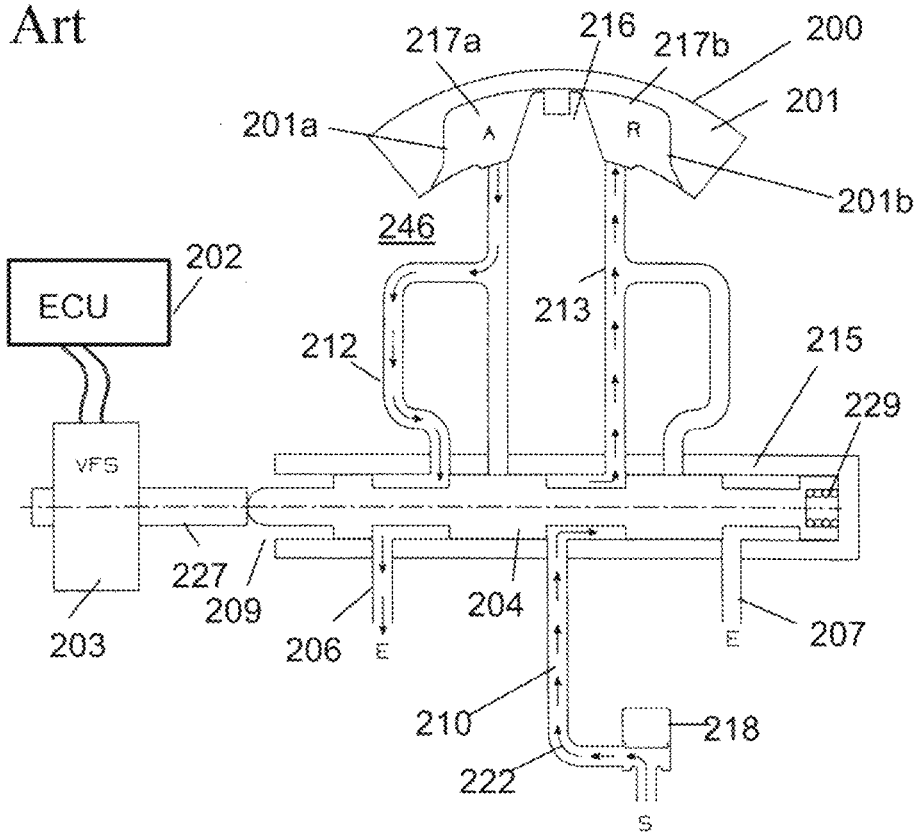
Fig. 1b Prior Art
FIG. 1*b* shows a schematic view of a prior art cam phaser with the control valve set for retard.
Figure 2:
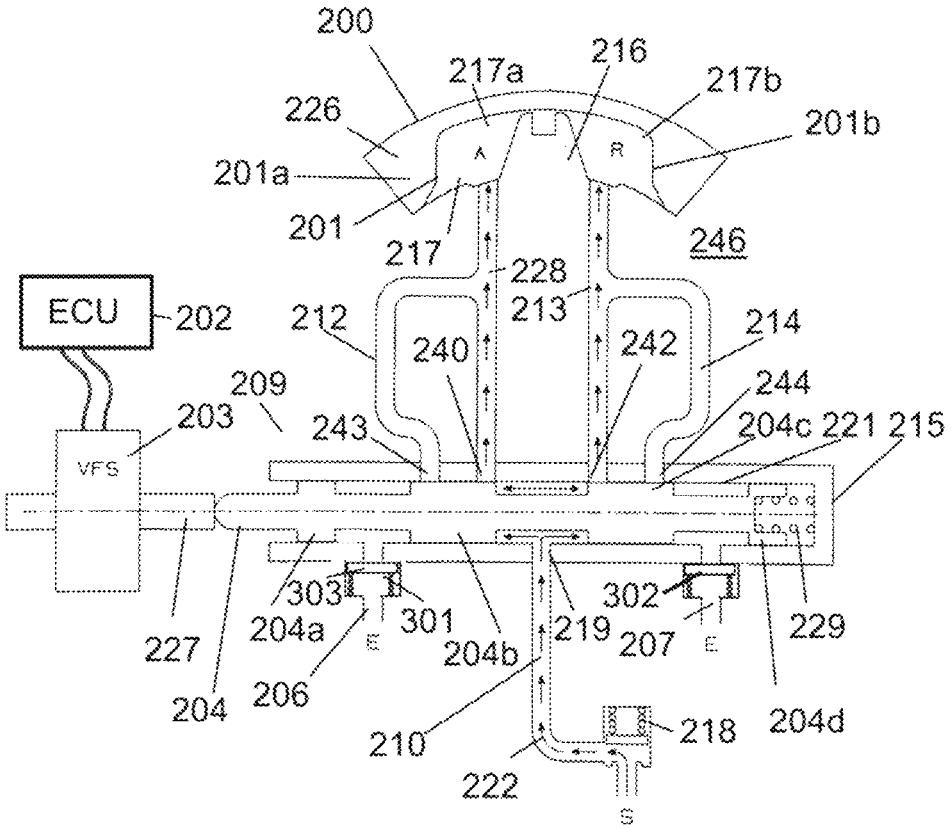
FIG. 2 shows a schematic view of the phaser of the invention, in which the phaser is in a holding position.
Figure 3A:
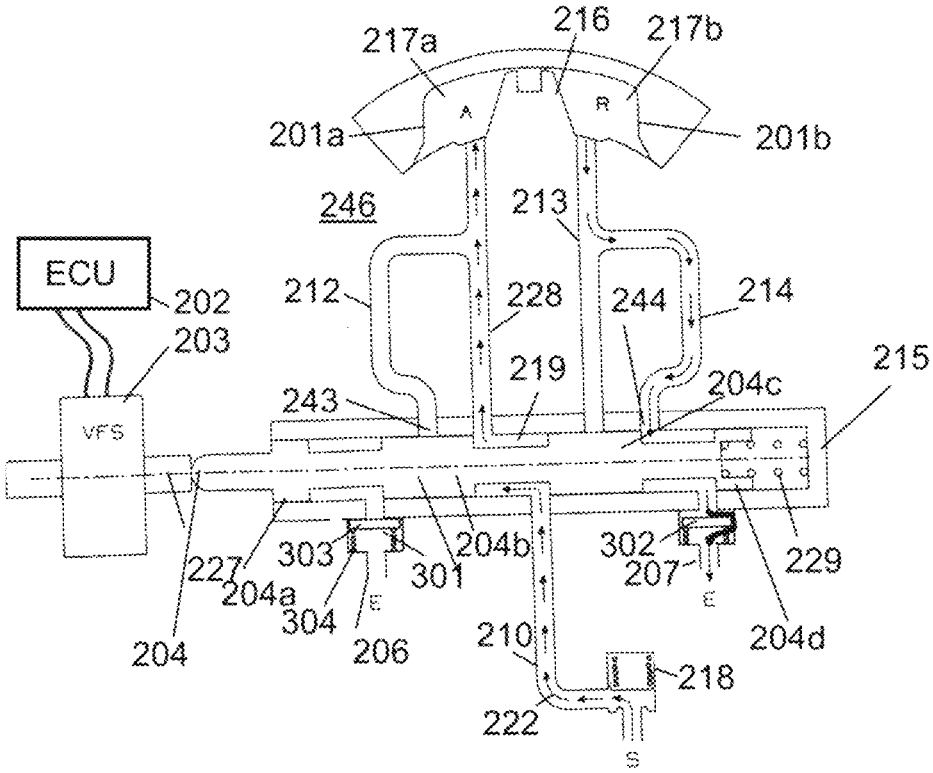
FIG. 3*a* shows a schematic view of a phaser of the invention, in which the phaser is being moved in the advance direction.
Figure 3B:
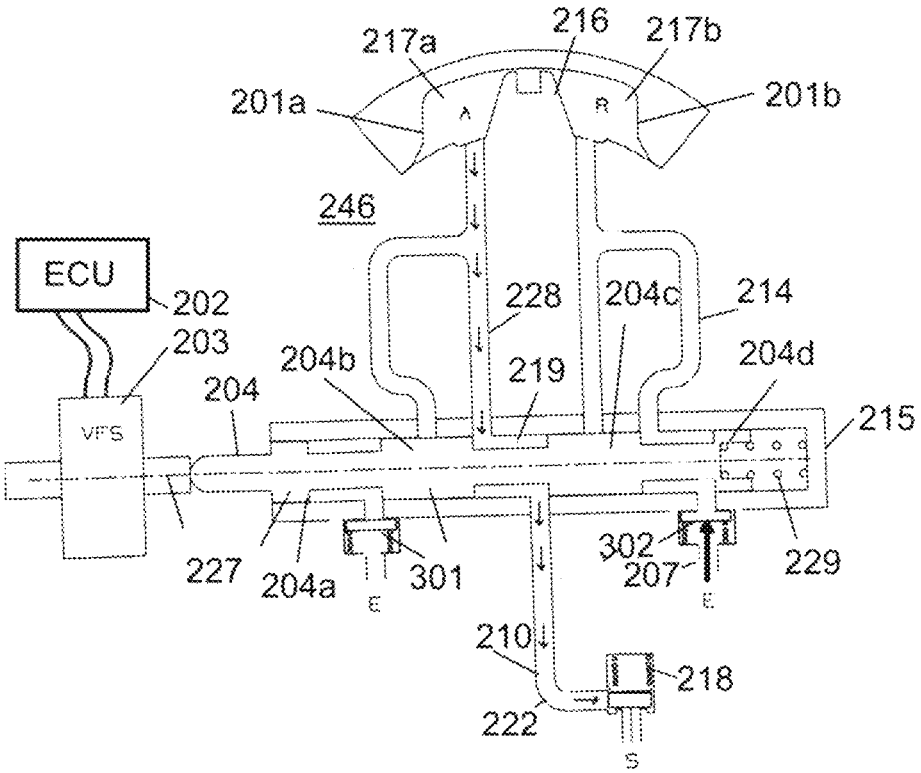
FIG. 3*b* shows a schematic view of a phaser of the invention, in which the phaser is being moved in the advance direction and the phaser is experiencing a torque reversal.

FIG. 2 shows a schematic view of the phaser of the invention of a first embodiment, in which the phaser is in a holding position. FIG. 3*a* shows a schematic view of a phaser of the invention, in which the phaser is being moved into or towards the advance direction. FIG. 3*b* shows a schematic view of a phaser of the invention, in which the phaser is being moved into or towards the advance direction and the phaser is experiencing a torque reversal.

The phaser operating fluid 222, illustratively in the form of engine lubricating oil, flows into the chambers 217*a* labeled "A" for "advance" and 217*b* labeled "R" for "retard" by way of a common inlet line 210. An inlet check valve 218 prevents the hydraulic fluid from backflow into the engine oil supply. Inlet line 210 terminates as it enters the spool valve 209. The spool valve 209 is made up of a spool 204 and a cylindrical member 215. The spool 204, which is preferably a vented spool, is slidable back and forth. The spool 204 fits snugly within cylindrical member 215. The spool has a plurality of lands 204*a*, 204*b*, 204*c*, 204*d*. The spool 204 preferably has at least three modes, which preferably include a holding mode, an advance mode and retard mode. The cylindrical member 215 has a plurality of ports, an advance exhaust port 206, a retard exhaust port 207, an advance line port 240 leading to the advance line 228 connected to the advance chamber 217*a*, a retard line port 242 leading to the retard line 213 connected to the retard chamber 217*b*, an advance return line port 243 in communication with the advance return line 212 and the advance chamber 217*a*, a retard return port 244 in communication with a retard return line 214 and the retard chamber 217*b*, and a common port 219 in communication with a common inlet line 210. The advance exhaust port 206 is connected to the advance chamber 217*a* through the control valve 209 and the retard exhaust port 207 is connected to the retard chamber 217*b* through the control valve 209 depending on the position of the spool 204. The advance exhaust port 206 has an advance exhaust check valve 301 and the retard exhaust port 207 has a retard exhaust check valve 302 each of which minimize air ingestion during cam torque reversals. While the advance exhaust check valve 301 and the retard exhaust check valve 302 are shown as comprising a moveable member 303 and a spring 304, with the moveable member 303 seating on the cylindrical member 215, other check valves, such as a flapper spring, a band check valve may also be used where resiliency is incorporated into the moveable member. The moveable member can be any shape which can seat on the cylindrical member.

Control of the position of spool 204 within member 215 is in direct response to an electromechanical actuator 203. An electrical current is introduced via a cable through the solenoid housing into a solenoid coil which repels, or "pushes" an armature 227 in the electromechanical actuator 203. The armature 227 bears against the spool 204, which is biased by a spring 229. If the force of spring 229 is in balance with the force exerted by armature 227 in the opposite direction, the spool 204 will remain in position. If the force of the spring 229 is greater than that exerted by the actuator 203, the spool 204 moves in one direction, and if the force of the actuator 203 is greater than that exerted by the spring 229, the spool 204 moves in the opposite direction. Thus, the spool 204 is moved in either direction by increasing or decreasing the current to the solenoid coil, as the case may be.

Referring to FIG. 2, hydraulic fluid 222 flows from a source S, through the inlet check valve 218 to a common inlet line 210. From the common inlet line 210, fluid flows to the advance line 228 in fluid communication with the advance chamber 217*a* and the retard line 213 in fluid communication with the retard chamber 217*b*. The spool 204 is positioned within the cylindrical member 215, such that the second spool land 204*b* blocks the flow of fluid from exiting the advance chamber 217*a* through the advance return line 212 and exiting to sump through the advance exhaust port 206. Similarly, the third spool land 204*c* blocks the flow of fluid from exiting the retard chamber 217*b* through the retard return line 214 and exiting to sump through the retard exhaust port 207. It should be noted that in the holding position, the second and third spool lands

204*b*, 204*c* are positioned such that a small amount of fluid can enter the advance line 228 and the retard line 213 to enter the advance chamber 217*a* and the retard chamber 217*b* respectively from the common inlet line 210. By having fluid enter both the advance chamber 217*a* and the retard chamber 217*b*, the position of the vane 216, as the pressure is approximately equal between the chambers.

Referring to FIG. 3*a*, to advance the phaser, the force of the spring 229 is greater than the force exerted by the actuator 203 and the spool 204 is moved to a position within the cylindrical member 215, such that the second land 204*b* blocks the flow of fluid from exiting the advance chamber 217*a* through the advance return line 212 and the flow of fluid to the advance exhaust port 206. The third land 204*c* blocks the flow of fluid from the common inlet line 210 from flowing to the retard chamber 217*b*. Fluid from the source S enters the common inlet line 210 and passes through the inlet check valve 218. From the common inlet line 210, fluid flows between the second land 204*b* and the third land 204*c* to the advance chamber 217*a* via the advance line 228, moving the vane 216 towards the retard wall 201*b*. At the same time, the fluid in the retard chamber 217*b* exits the chamber through the retard line 213 and the retard return line 214. From the retard return line 214, fluid passes through the spool 204 between spool lands 204*c* and 204*d*, and passes through the retard exhaust check valve 302 to exhaust to sump through the retard exhaust port 207.

While not shown, to retard the phaser, the force of the spring 229 is less than the force exerted by the actuator 203 and the spool 204 is moved to a position within the cylindrical member 215, such that the third land 204*c* blocks the flow of fluid from exiting the retard chamber 217*b* through the retard return line 214 and the flow of fluid to the retard exhaust port 207. The second land 204*b* blocks the flow of fluid from the common inlet line 210 from flowing to the advance chamber 217*a*. Fluid from the source S enters the common inlet line 210 and passes through the inlet check valve 218. From the common inlet line 210, fluid flows between the second land 204*b* and the third land 204*c* to the retard chamber 217*b* via the retard line 213, moving the vane towards the advance wall 201*a*. At the same time, the fluid in the advance chamber 217*a* exits the chamber through the advance line 228 and the advance return line 212. From the advance return line 212, fluid passes through the spool 204 between spool lands 204*c* and 204*d*, and passes through the advance exhaust check valve 301 to exhaust to sump through the advance exhaust port 206.

FIG. 3*b* shows a schematic view of a phaser of the invention, in which the phaser is being moved in the advance direction and the phaser is experiencing a torque reversal.

In internal combustion engines, the camshaft on which the phaser is mounted is acted upon by forces imparted by the intake and/or exhaust valves which are operated by the cams on the camshaft. These forces, called "torsionals" or "torque reversals", cause the camshaft to twist, slightly oscillating angularly back and forth, rather than rotating smoothly. As a result, while the variable cam timing system is attempting to move the phaser toward the advance or retard positions, the phaser is subject to torsional forces which can make the vanes of the phaser move back and forth within the chambers, overcoming the oil pressure which is attempting to move the vane in one direction or the other.

It will be noted that in either of the advancing position of FIG. 3*a* or the retarding position (not shown), the vent or exhaust ports 206 and 207 cannot freely communicate with the atmosphere (instead they communicate with oil sump of the engine, which is at atmospheric pressure) as both the exhaust ports 206, 207 contain check valves 301, 302, which only allow fluid to exit the exhaust ports 206, 207.

Therefore, if the phaser is being moved toward the advance position as in FIG. 3*b*, for example, and if the rotor assembly 246 of the phaser experiences a torque reversal toward the retard direction, the retard exhaust check valve 302 prevents suction created by the movement of the vane 216 toward retard, and therefore prevents air from the oil sump from being sucked back into the retard chamber 217*b* through the exhaust port 207. This similarly works when the phaser is being moved towards the retard position. If the phaser experiences a torque reversal toward the advance direction, the advance exhaust check valve 301 prevents suction created by the movement of the vane 216 toward the advance position and therefore prevents air from the oil sump from being sucked back into the advance chamber 217*a* through the exhaust port 206.

The check valves 301, 302 may be any type of check valve, included, but not limited to a band check valve, a disc check valve, ball check valve or a combination thereof.

It should be noted that while two check valves 301, 302 are shown on each exhaust port, a single check valve on one of the exhaust ports 206, 207 may be also be used.

Figure 4:
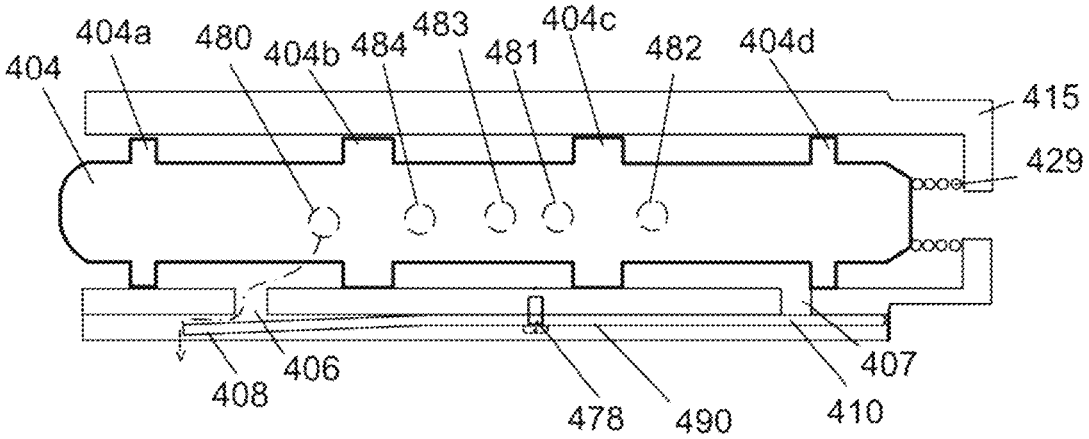
FIG. 4 shows a cut-through view of an alternate embodiment of the invention, in which the check valves are incorporated into the sleeve of the spool valve of the phaser.
Figure 5:
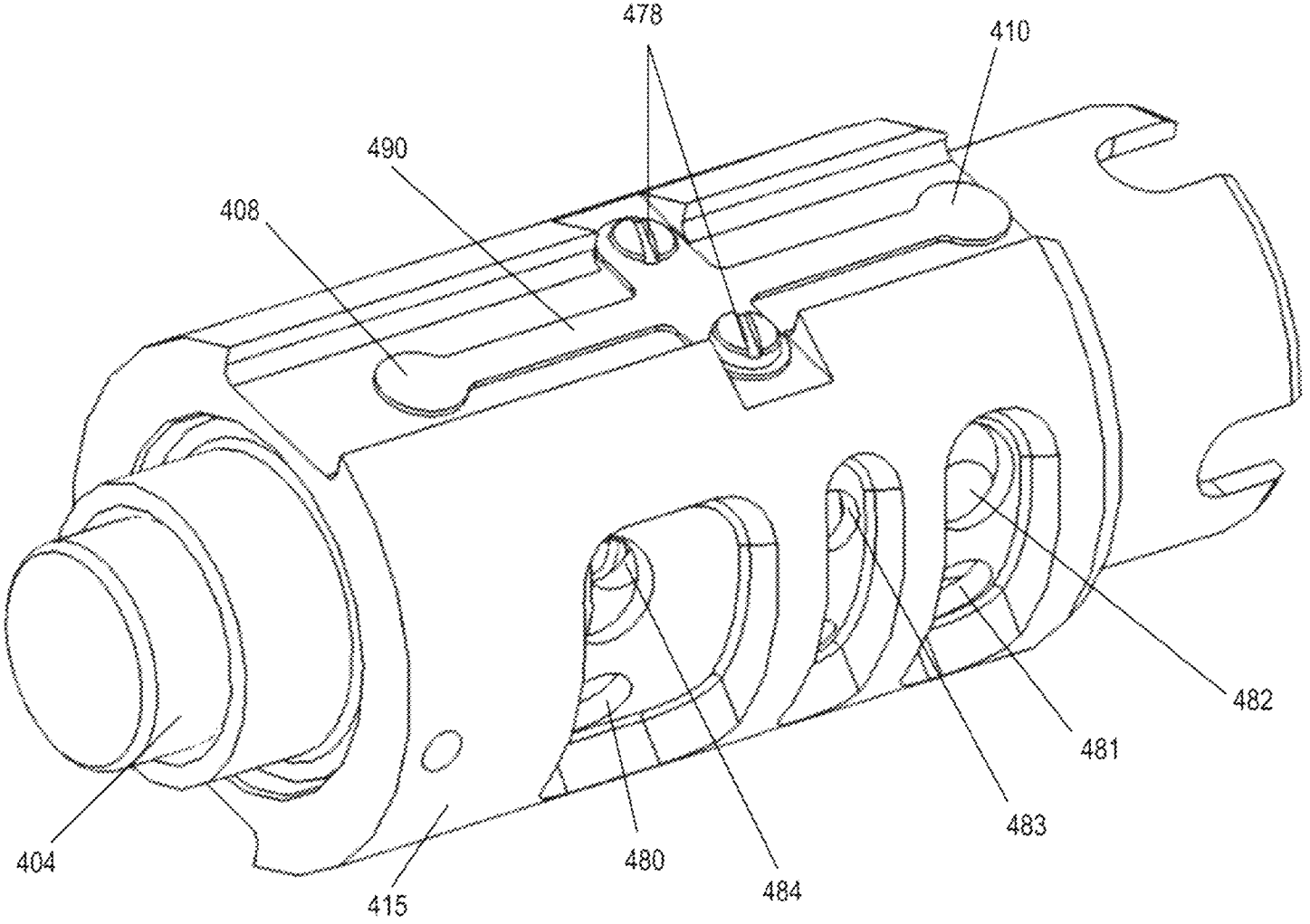
FIG. 5 shows a perspective view of the alternate embodiment of the invention, in which the check valves are incorporated into the sleeve of the spool valve of the phaser.
Figure 6:
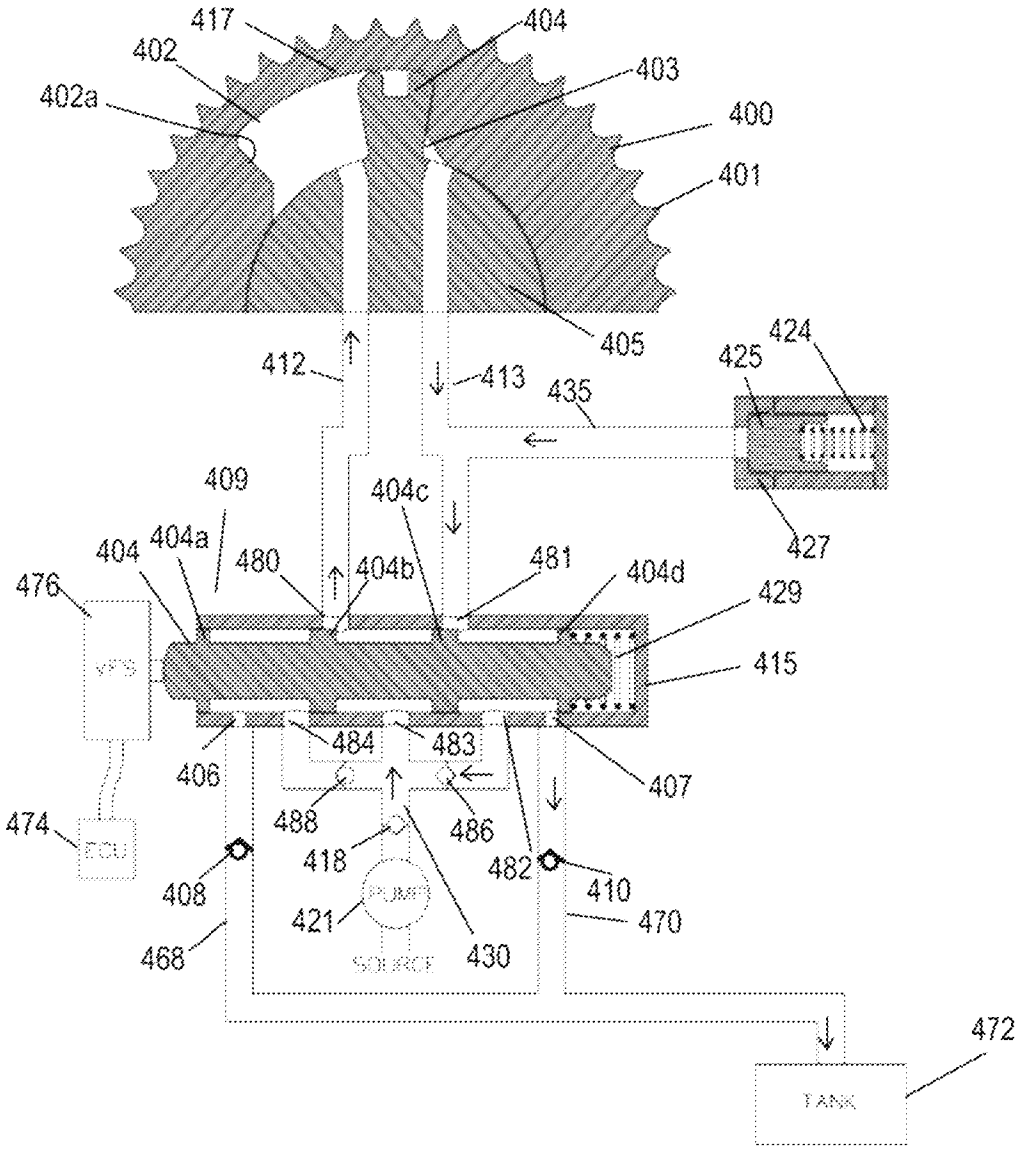
FIG. 6 shows a schematic view of a phaser of the alternate embodiment of FIGS. 4-5, in which the phaser is moved into or towards the advance position.
Figure 7:
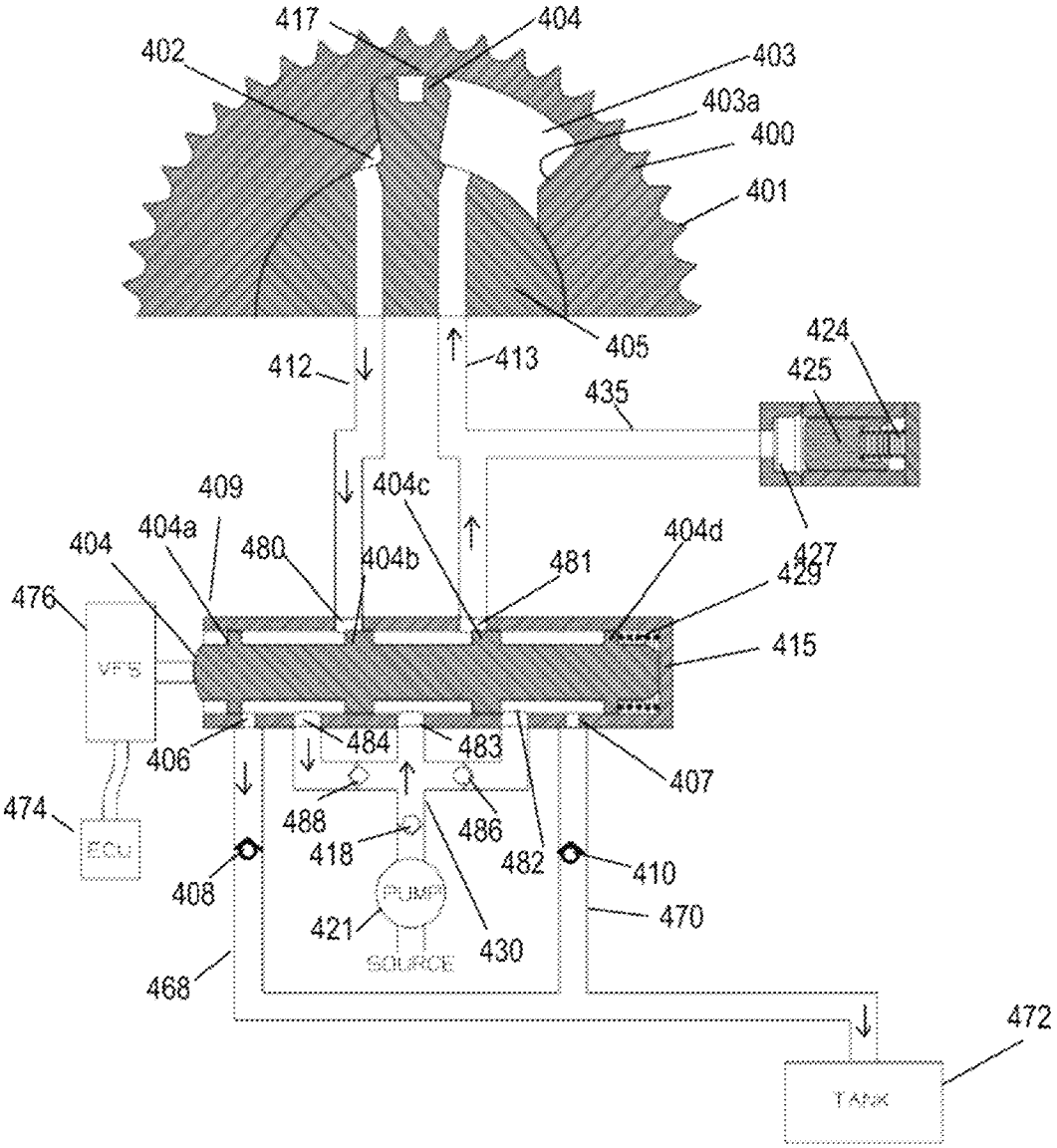
FIG. 7 shows a schematic view of a phaser of the alternate embodiment of FIGS. 4-5, in which the phaser is moved into or towards the retard position.
Figure 8:
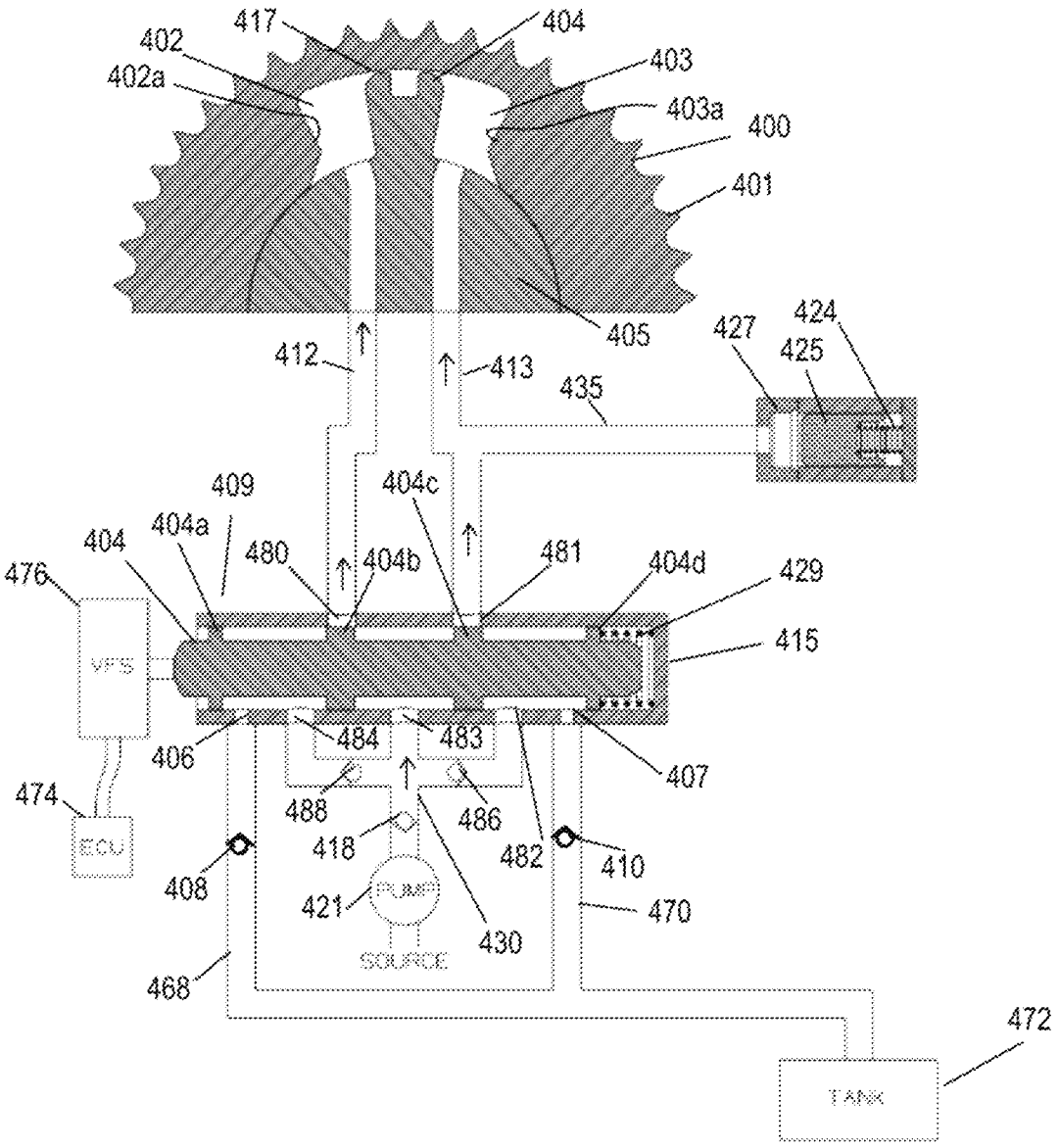
FIG. 8 shows a schematic view of a phaser of the alternate embodiment of FIGS. 4-5, in which the phaser is moved to the holding position.

FIGS. 6-9 shows schematic views of a phaser of an alternate embodiment using the control valve of FIGS. 4-5. FIGS. 6-8 show the operating modes of a VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor assembly 405 with one or more vanes 404, mounted to the end of the camshaft (not shown), surrounded by a housing assembly 400 with the vane chambers into which the vanes 404 fit. It is possible to have the vanes 404 mounted to the housing assembly 400, and the chambers in the rotor assembly 405, as well. The housing's outer circumference 401 forms the sprocket, pulley or gear accepting drive force through a chain, belt, or gears, usually from the crankshaft, or possible from another camshaft in a multiple-cam engine.

The housing assembly 400 of the phaser has an outer circumference 401 for accepting drive force. The rotor assembly 405 is connected to the camshaft and is coaxially located within the housing assembly 400. The rotor assembly 405 has a vane 404 separating a chamber 417 formed between the housing assembly 400 and the rotor assembly 405 into an advance chamber 402 and a retard chamber 403. The chamber 417 has an advance wall 402*a*, and a retard wall 403*a*. The vane 404 is capable of rotation to shift the relative angular position of the housing assembly 400 and the rotor assembly 405.

A lock pin 425 is slidably housed in a bore in the rotor assembly 405 and has an end portion that is biased towards and fits into a recess 427 in the housing assembly 400 by a spring 424. Alternatively, the lock pin 425 may be housed in the housing assembly 400 and be spring 424 biased towards a recess 427 in the rotor assembly 405. The position of the lock pin 425 is controlled by the movement of the control valve 409.

A control valve 409, preferably a spool valve, includes a spool 404 with cylindrical lands 404*a*, 404*b*, 404*c*, 404*d* slidably received in a sleeve 415 within a bore in the rotor assembly 405 and pilots in the camshaft (not shown). The control valve 409 may be located remotely from the phaser, within a bore in the rotor assembly 405 which pilots in the camshaft, or in a center bolt of the phaser. One end of the spool 404 contacts spring 429 and the opposite end of the spool 404 contacts a pulse width modulated variable force solenoid (VFS) 476. The solenoid 476 may also be linearly controlled by varying current or voltage or other methods as applicable. Additionally, the opposite end of the spool 404 may contact and be influenced by a motor, or other actuators.

Referring to FIGS. 4-5, check valves are incorporated into the sleeve or cylindrical member 415 of the control valve 409 of the phaser. The check valves for the exhaust ports 406, 407 are flaps 408, 410 of a resilient flapper spring 490 which are secured to the sleeve 415 of the spool 404 of the control valve 409 via at least one screw 478. The flaps 408, 410 of the flapper spring 490 allow fluid to exit through the advance exhaust port 406 and the retard exhaust port 407 to atmosphere or tank 472 only, and act essentially as check valves. The flaps 408, 410 of the flapper spring 490 are biased towards a closed position, such that during a torque reversal, air cannot be sucked into the advance and retard chambers 402, 403, for example into chambers 402, 403 from sump through the exhaust ports 406, 407 as shown in FIGS. 6-8. In another embodiment, the flaps 408, 410 are preloaded against the cylindrical member 415, for example by the resilient flapper spring 490, to create higher opening pressures for the flaps. The spring force preloaded against resilient flapper spring 490 can be adjusted based on the force associated with the cam torque reversal.

While screws 478 are used to secure the flapper spring 490 to the sleeve 415, other means can be used.

In an alternate embodiment, the flapper spring 490 can be incorporated into an overmold sleeve and the screw 478 can be eliminated.

The spring rate of the flapper spring 490 can also be sized to force a cam torque actuation function, e.g. recirculation between the advance and retard chambers 402, 403 until a desired recirculation pressure is achieved.

The sleeve 415 of the control valve 409 also has a series of ports 480-484 and vent orifices 406-407. The port 480 is in fluid communication with the advance line 412, which is in fluid communication with the advance chamber 402. Port 481 is in fluid communication with retard line 413, which is in fluid communication with the retard chamber 403 and line 435 leading to the lock pin 425. Port 482 is in fluid communication with vent orifice 406. Vent orifice 406 is in communication with tank 472 through line 468 with flap 408. Port 483 is in fluid communication with inlet line 418. Port 484 is in fluid communication with vent orifice 407 and vent orifice 407 is in communication with tank 472 through line 470 with flap 410. An advance check valve 488 is present between inlet line 430 and port 484 and retard check valve 486 is present between inlet line 430 and port 482 (see FIGS. 6-9).

The vent orifices 406 and 407 can vary in size. The variation in size of the vent orifices 406, 407 as well as the preload pressure of the check valve 408, 410 determines the amount of fluid which recirculates between the advance and retard chambers 402, 403. If the vent orifice 406, 407 is very small, more fluid will recirculate between the advance and retard chambers 402, 403 and the phaser will function more similarly to a cam torque actuated phaser. If the vent orifices 406, 407 are large, the phaser will function more similarly to a torsion assisted phaser.

Furthermore, the preload pressure of the check valve 408, 410 can be adjusted to further alter the amount of recirculation between the advance and retard chambers 402, 403. For example, the preload pressure of the check valve 408, 410 may be set to be high, meaning that a high fluid force or pressure is required to open the check valve 408, 410 and allow fluid to flow through the check valve 408, 410. When the preload pressure of the check valve 408, 410 is high, recirculation between the advance and retard chambers 402, 403 occurs until the fluid pressure is high enough to open the check valve 408, 410.

In another example, the preload pressure of the check valve 408, 410 is low, requiring a low fluid force or pressure to open the check valve 408, 410 and allow fluid to flow through the check valve 408, 410. When the preload pressure of the check valve 408, 410 is low, exhaustion of fluid from the advance and retard chambers 402, 403 occurs with little recirculation between the advance and retard chambers 402, 403.

The flaps 408, 410 are depicted schematically in FIGS. 6-9 as ball-type check valves, although it will be understood that they correspond to flaps shown in FIG. 5. Furthermore, the check valves may be any type of check valve, included, but not limited to a band check valve, a disc check valve, ball check valve or a combination thereof.

The position of the control valve 409 is controlled by an engine control unit (ECU) 474 which controls the duty cycle of the variable force solenoid 476. The ECU 474 preferably includes a central processing unit (CPU) which runs various computational processes for controlling the engine, memory, and input and output ports used to exchange data with external devices and sensors.

The position of the spool 404 is influenced by spring 429 and the solenoid 476 controlled by the ECU 474. Further detail regarding control of the phaser is discussed in detail below. The position of the spool 404 controls the motion (e.g. to move towards the advance position, holding position, or the retard position) of the phaser as well as whether the lock pin 425 is locked or unlocked. The control valve 409 has at least an advance mode, a retard mode, and a null mode (holding position).

In the advance mode, the spool 404 is moved to a position so that fluid may flow from the retard chamber 403 through the spool 404 and to sump or tank 472 via exhaust line 470. Fluid is blocked from exiting the advance chamber 402. The lock pin 425 is in a locked position. If the rotor assembly 405 experiences a torque reversal towards the retard direction, the flap 410 prevents suction created by the movement of the vane 404 towards advance wall 402*a*, and therefore prevents air from tank 472 from being sucked back into the retard chamber 403 through the vent orifice 407.

In the retard mode, the spool 404 is moved to a position so that fluid may flow from the advance chamber 402 through the spool 404 and to sump or tank 472 via exhaust line 468. Fluid is blocked from exiting the retard chamber 403. The lock pin 425 is in an unlocked position. If the rotor assembly 405 experiences a torque reversal toward the advance direction, the flap 408 prevents suction created by the movement of the vane 404 toward retard wall 403*a*, and therefore prevents air from the oil sump from being sucked back into the advance chamber 403 through vent orifice 406.

In null mode, the spool 404 is moved to a position that blocks the exit of fluid from the advance and retard chambers 402, 403 to the tank 472. In the null mode the lock pin 425 is in an unlocked position.

FIG. 6 shows a schematic view of a phaser of the embodiment of FIGS. 4-5, in which the phaser is moved into the advance position.

To move towards the advance position, the duty cycle is adjusted such that the force of the VFS 476 on the spool 404 is changed and the spool 404 is moved to the left in an advance mode in the figure by spring 429, until the force of the VFS 476 balances the force of the spring 429. Fluid exits from the retard chamber 403 through retard line 413 to port 481 and to the control valve 409 between spool lands 404*c* and 404*d*. From the control valve 409, fluid flows through vent orifice 407 to line 470, through flap 410 and to tank 472. Exhausting fluid from the retard chamber 403 can also flow through check valve 486 and can be used to replenish the advance chamber 402 through the advance line 412.

Fluid additionally exits lock pin line 435 to the control valve 409. Without pressurized fluid, the spring 424 biases the lock pin 425 to engage recess 427 of the housing assembly 401, moving the lock pin to a locked position in which the rotation of the rotor assembly 405 relative to the housing assembly 401 is prevented.

Figure 9:
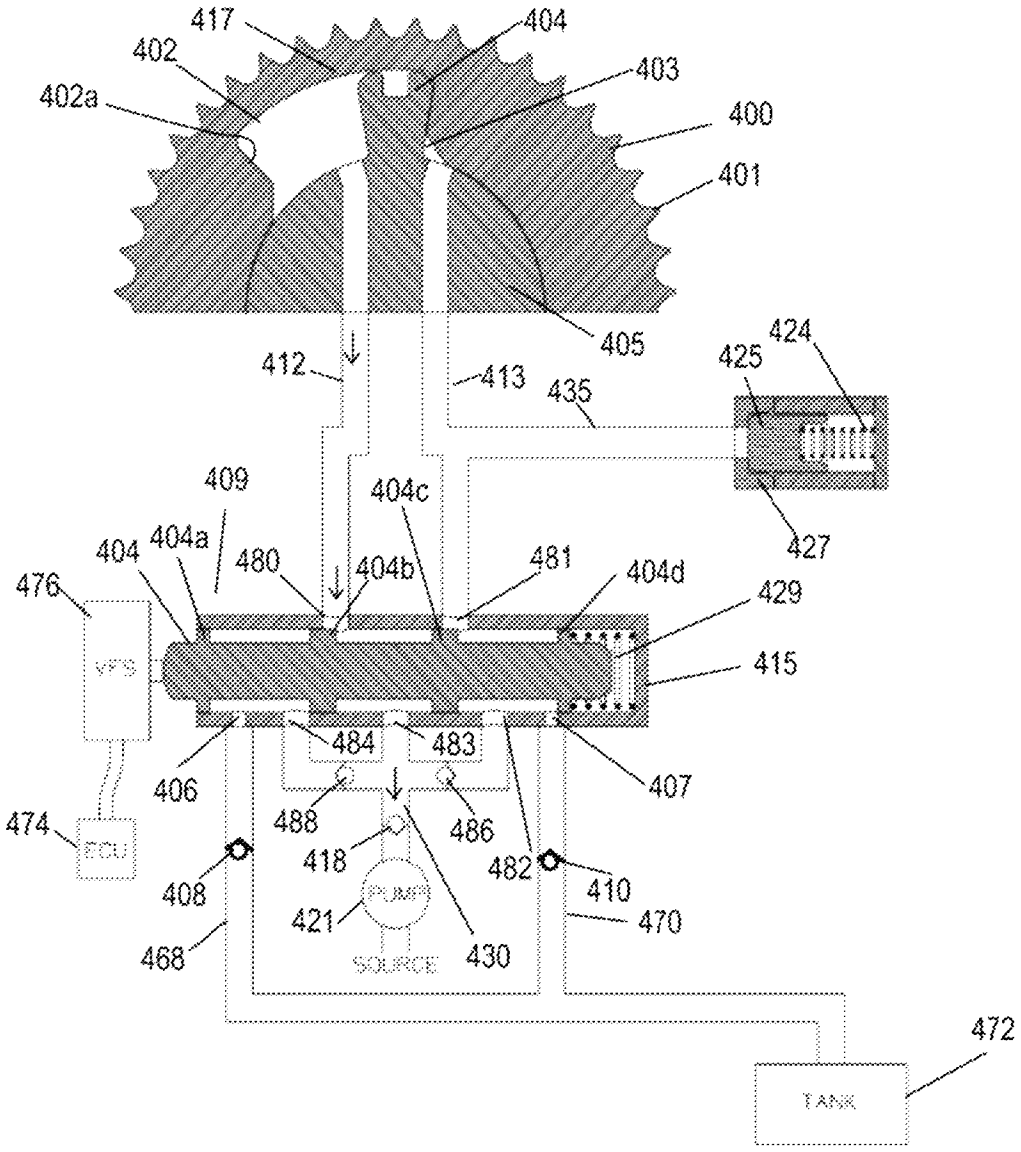
FIG. 9 shows a schematic view of a phaser of the alternate embodiment of FIGS. 4-5, in the advance position during a cam torque reversal.

If the rotor assembly 405 experiences a torque reversal towards the retard direction, the flap 410 prevents suction created by the movement of the vane 404 towards advance wall 402*a*, and therefore prevents air from tank 472 from being sucked back into the retard chamber 403 through the vent orifice 407 as shown in FIG. 9.

Fluid is supplied from source by pump 421 flows through inlet line 430, through inlet check valve 418 to the control valve 409 through port 483. From port 483, fluid passes between spool lands 404*b* and 404*c* to port 480 and advance line 412. Fluid from advance line 412 enters the advance chamber 402.

FIG. 7 shows a schematic view of a phaser of an alternate embodiment using the control valve of FIGS. 4-5, in which the phaser is moved into the retard position.

To move towards the retard position, the duty cycle is adjusted such that the force of the VFS 476 on the spool 404 is changed and the spool 404 is moved to the right in the retard mode in the figure by VFS 476, until the force of the VFS 476 balances the force of the spring 429. Fluid exits from the advance chamber 402 through advance line 412 to port 480 and to the control valve 409 between spool lands 404*a* and 404*b*. From the control valve 409, fluid flows through vent orifice 406 to line 468, through flap 408 and tank 472. Exhausting fluid from the advance chamber 402 can also flow through check valve 488 and can be used to replenish retard chamber 403 through the retard line 413.

Fluid is supplied from source by pump 421 flows through inlet line 430, through inlet check valve 418 to the control valve 409 through port 483. From port 483, fluid passes between spool lands 404*b* and 404*c* to port 481 and retard line 413. Fluid from retard line 413 enters the retard chamber 403 and also enters lock pin line 435. Fluid from supply biases the lock pin 425 against the spring 424, such that the lock pin 425 is in an unlocked position and does not engage the recess 427 of the housing assembly 401.

If the rotor assembly 405 experiences a torque reversal toward the advance direction, the flap 408 prevents suction created by the movement of the vane 404 toward retard wall 403*a*, and therefore prevents air from the oil sump from being sucked back into the advance chamber 403 through vent orifice 406.

FIG. 8 shows a schematic view of a phaser of an alternate embodiment using the control valve of FIGS. 4-5, in which the phaser is moved in the holding position.

In this position, the force of the VFS 476 on one end of the spool 404 equals the force of the spring 429 on the opposite end of the spool 404 in holding mode. Spool land 404*b* mostly blocks the flow of fluid to advance line 412 and spool land 411*c* blocks the flow of fluid to retard line 413. Makeup oil is supplied to the phaser from supply S by pump 421 to make up for leakage and enters line 430 and passes through the inlet check valve 418. From line 430, fluid enters the control valve 409 between spool lands 404*b* and 404*c*. A small amount of fluid can flow to the advance line 412 and the retard line 413 for makeup purposes only either through undercuts of the lands or through dithering of the spool 404 itself in this position. The lock pin 425 is in an unlocked position.

In the above embodiments, two check valves are shown, one for the advance exhaust line and one for the retard line, however it is within the scope of the invention to hydraulically connect the two exhaust ports and use a single check valve to control the exhaustion of fluid from both exhaust ports.

In yet another embodiment, where the phaser has a single exhaust port, a single check valve may be present on the single exhaust port.

In the above embodiments, the check valves on the exhaust ports may alternatively be present in the rotor assembly adjacent the control valve, in a center bolt housing of the control valve, or the cam to reduce the air ingested into the phaser.

In another embodiment, an intermediate chamber may be present between the check valve on the exhaust port and the engine sump for temporarily collecting exhausting fluid. The intermediate chamber may be present outside of the phaser, for example in the cam or elsewhere in the engine.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser mounted to a camshaft, of an internal combustion engine, the variable cam timing phaser comprising:

a housing assembly having an outer circumference configured to accept a drive force;

a rotor assembly received by the housing assembly so as to define a chamber separated into an advance chamber and a retard chamber by a vane;

a control valve in fluid communication with the advance chamber and the retard chamber, a source of fluid, and a sump through at least one exhaust line of the control valve connected to at least one exhaust port of the control valve; and at least one check valve in the at least one exhaust line between the control valve and the sump;

wherein during a torque reversal of the camshaft, the at least one check valve prevents air from the sump from being sucked into the variable cam timing phaser through the at least one exhaust port.

2. The variable cam timing phaser of claim 1, wherein the control valve comprises a sleeve comprising:

an outer surface receiving the at least one check valve at the at least one exhaust port; and a bore configured to slidably receive a spool within the sleeve.

3. The variable cam timing phaser of claim 2, wherein the at least one check valve is a flap of a flapper spring secured to the outer surface of the sleeve.

4. The variable cam timing phaser of claim 3, wherein the flapper spring is secured to the outer surface of the sleeve via a fastener.

5. The variable cam timing phaser of claim 3, wherein the flapper spring is overmolded onto the outer surface of the sleeve.

6. The variable cam timing phaser of claim 3, wherein the flapper spring is preloaded against the at least one exhaust port.

7. The variable cam timing phaser of claim 1, wherein the at least one check valve is selected from a group consisting of: a ball check valve, a band check valve, and a disc check valve.

8. The variable cam timing phaser of claim 1, further comprising an intermediate chamber between the sump and the at least one exhaust port, the intermediate chamber configured to accumulate exhausted fluid.

9. The variable cam timing phaser of claim 1, wherein the control valve is received within a center bolt housing of a center bolt in the rotor assembly.

10. A variable cam timing phaser mounted to a camshaft, of an internal combustion engine, the variable cam timing phaser comprising:

a housing having an outer circumference configured to accept a drive force;

a rotor received by the housing so as to define a chamber separated into an advance chamber and a retard chamber by a vane;

a control valve comprising:

a sleeve having a bore and an outer surface receiving a first check valve at a first exhaust port of the control valve and a second check valve at a second exhaust port of the control valve; and a spool having a plurality of lands slidably received within the bore;

wherein during a torque reversal of the camshaft, the first check valve and the second check valve prevent air from a sump connected to the first exhaust port and the second exhaust port from being sucked into the advance chamber or the retard chamber through the first exhaust port and the second exhaust port, respectively.

11. The variable cam timing phaser of claim 10, wherein the first check valve is a first flap of a flapper spring secured to the outer surface of the sleeve and the second check valve is a second flap of the flapper spring.

12. The variable cam timing phaser of claim 11, wherein the flapper spring is secured to the outer surface of the sleeve via a fastener.

13. The variable cam timing phaser of claim 11, wherein the flapper spring is overmolded onto the outer surface of the sleeve.

14. The variable cam timing phaser of claim 11, wherein the flapper spring is preloaded against the first exhaust port and the second exhaust port.

15. A variable cam timing phaser mounted to a camshaft, of an internal combustion engine, the variable cam timing phaser comprising:

a housing assembly having an outer circumference configured to accept a drive force;

a rotor assembly received by the housing assembly so as to define a chamber separated into an advance chamber and a retard chamber by a vane;

a control valve received in a center bolt housing in the rotor assembly, the control valve in fluid communication with the advance chamber and the retard chamber, a source of fluid, and a sump through at least one exhaust line of the control valve through the center bolt housing, the control valve comprising:

a sleeve having a bore and an outer surface receiving at least one check valve at an exhaust port of the control valve; and a spool having a plurality of lands slidably received within the bore of the sleeve;

wherein during a torque reversal of the camshaft, the at least one check valve prevents air from the sump from being sucked into the variable cam timing phaser through the at least one exhaust port line of the control valve.

* * * * *